US011274827B2

(12) United States Patent
Cook

(10) Patent No.: US 11,274,827 B2
(45) Date of Patent: Mar. 15, 2022

(54) PILOT ASSEMBLIES AND METHODS FOR ELEVATED FLARE STACKS

(71) Applicant: Surefire Pilotless Burner Systems LLC, Farmington, NM (US)

(72) Inventor: Ronnie Cook, Farmington, NM (US)

(73) Assignee: Surefire Pilotless Burner Systems LLC, Farmington, NM (US)

( * ) Notice: Subject to any disclaimer, the term of this patent is extended or adjusted under 35 U.S.C. 154(b) by 0 days.

(21) Appl. No.: 16/247,553

(22) Filed: Jan. 14, 2019

(65) Prior Publication Data

US 2019/0226679 A1 Jul. 25, 2019

Related U.S. Application Data

(60) Provisional application No. 62/619,763, filed on Jan. 20, 2018.

(51) Int. Cl.

| | |
|---|---|
| ***F23Q 9/08*** | (2006.01) |
| ***F23D 14/58*** | (2006.01) |
| ***F23G 7/08*** | (2006.01) |
| ***F23D 14/70*** | (2006.01) |

(52) U.S. Cl.

CPC ..... *F23Q 9/08* (2013.01); *F23D 14/58* (2013.01); *F23G 7/085* (2013.01); *F23D 14/70* (2013.01)

(58) Field of Classification Search

CPC . F23D 14/58; F23D 14/70; F23Q 9/10; F23Q 9/00; F23G 7/085; F23G 2209/14; F23N 2227/22

See application file for complete search history.

(56) References Cited

U.S. PATENT DOCUMENTS

| | | | | | |
|---|---|---|---|---|---|
| 2,869,631 | A * | 1/1959 | Zink | F23Q 9/00 | 431/202 |
| 4,147,498 | A | 4/1979 | Clarke | | |
| 4,405,299 | A * | 9/1983 | Serber | F23Q 7/10 | 431/25 |
| 4,887,959 | A * | 12/1989 | Shellenberger | F23Q 7/26 | 431/46 |
| 5,035,607 | A * | 7/1991 | Peterson | F23Q 9/00 | 431/46 |
| 5,302,113 | A * | 4/1994 | Eichelberger | F23Q 9/00 | 431/155 |
| 5,634,788 | A * | 6/1997 | Rajewski | F23G 7/085 | 431/202 |
| 5,951,276 | A * | 9/1999 | Jaeschke | F23Q 7/12 | 431/66 |
| 5,954,493 | A * | 9/1999 | Rajewski | F23Q 9/00 | 431/202 |

(Continued)

*Primary Examiner* — Edelmira Bosques
*Assistant Examiner* — Martha M Becton
(74) *Attorney, Agent, or Firm* — ipTekk, LLC; Anand S. Chellappa

(57) ABSTRACT

Pilot assemblies comprising a fire path tubing and pilot tubing in fluid communication through a pilot nozzle for elevated flare stacks are disclosed. A plurality of flame segments is generated using a hot surface ignition element or a spark igniter in the fire path tubing and ignites fuel/air mixture flowing through the pilot tubing into a pilot nozzle to produce a reliable pilot flame. The pilot flame ignites the waste gases flowing out of the flare tip of elevated flare stacks. Methods for operating the pilot assemblies are also disclosed.

18 Claims, 7 Drawing Sheets

(56) References Cited

U.S. PATENT DOCUMENTS

| | | | | |
|---|---|---|---|---|
| 6,840,761 | B2 * | 1/2005 | Hong | F23G 7/085 431/202 |
| 7,654,820 | B2 * | 2/2010 | Deng | F23N 1/005 431/74 |
| 8,177,544 | B2 * | 5/2012 | Anderson | F23N 5/082 431/6 |
| 8,317,511 | B2 * | 11/2012 | Deng | F23N 1/005 431/74 |
| 8,434,292 | B2 * | 5/2013 | Eason | F02C 7/266 60/39.821 |
| 8,629,313 | B2 * | 1/2014 | Hong | F23G 5/50 588/320 |
| 9,097,422 | B2 * | 8/2015 | Deng | F23Q 9/10 |
| 9,267,686 | B1 | 2/2016 | Little et al. | |
| 9,494,320 | B2 * | 11/2016 | Chian | F23Q 5/00 |
| 10,101,028 | B2 * | 10/2018 | Loveless | F23Q 9/00 |
| 10,208,954 | B2 * | 2/2019 | Chian | F23N 5/242 |
| 10,429,068 | B2 * | 10/2019 | Chian | F23Q 5/00 |
| 10,514,166 | B2 * | 12/2019 | Soliman | F23G 7/085 |
| 10,527,285 | B2 * | 1/2020 | Cook | F23Q 7/00 |
| 10,907,829 | B2 * | 2/2021 | Loveless | F23N 5/02 |
| 2006/0172238 | A1 | 8/2006 | Cook | |
| 2012/0088199 | A1 * | 4/2012 | Yantis | F23D 14/70 431/12 |
| 2012/0282555 | A1 * | 11/2012 | Cody | F23G 7/085 431/5 |
| 2013/0323658 | A1 * | 12/2013 | Kraus | F23N 5/16 431/13 |
| 2016/0209032 | A1 * | 7/2016 | Loveless | F23N 5/12 |
| 2017/0284669 | A1 * | 10/2017 | Cook | F23Q 9/08 |
| 2019/0063743 | A1 * | 2/2019 | Soliman | F23Q 21/00 |
| 2019/0093023 | A1 * | 3/2019 | Cook | F23D 14/56 |
| 2019/0178494 | A1 * | 6/2019 | Loveless | F23Q 9/00 |
| 2019/0242575 | A1 | 8/2019 | Fisher et al. | |
| 2020/0025372 | A1 | 1/2020 | Cassidy | |

* cited by examiner

PILOT ASSEMBLIES AND METHODS FOR ELEVATED FLARE STACKS

CROSS REFERENCE TO RELATED APPLICATIONS

This application is related to and claims the benefit of and priority to U.S. Provisional Patent Application No. 62/619,763, filed Jan. 20, 2018, and entitled "Pilot Assemblies and Methods for Elevated Flare Stacks," the entire disclosure of which is hereby incorporated herein by reference in its entirety.

FIELD

The present invention relates to combustion of waste gases in oil and gas fields using elevated flare stacks. In particular, it relates to pilot assemblies and methods that comprise a fire path tubing for generating a plurality of flame segments using a hot surface ignition element, which then ignites fuel/air mixture in a pilot assembly nozzle to produce a reliable pilot flame.

BACKGROUND

Gas flaring is an important unit operation employed during the exploration, production and processing of natural gas and oil from oil and gas wells. Flaring is regulated by federal and state regulations in the U.S. Flaring is done after an oil/gas well is drilled during well production testing until the flow of liquids and gas from the well, oil and gas compositions, and pressures are stabilized. Flaring is also done as a safety measure to release gas from storage vessels and other process equipment to prevent fire and explosions during maintenance and repairs of process units and wells. Finally, flaring is done during treatment processes such as oil/water separators, and dehydrators (or treaters), wherein the waste gas cannot be efficiently captured. A flare system comprises of a flare stack, piping that feed gas to the stack, and an ignition system.

Natural gas is a byproduct formed during oil extraction from oil wells, and is typically referred to as wellhead gas. Wellhead gas comprises a mixture of methane, ethane, propane, nitrogen, carbon dioxide, and water. In addition, wellhead gas may contain varying amounts of sulfur compounds such as hydrogen sulfide. Ignition of waste gases in flare stacks is initiated and controlled using a burner management system (BMS). The burner management system controls the operation of an igniter. Ignition in turn could be achieved by spark ignition or sparkless ignition. Flare stacks require a pilot flame to ensure that any waste gases released are burnt efficiently. In the case of spark ignition, the sparking tips require periodic cleaning to remove carbon accumulation formed as a byproduct of combustion. Further, periodic adjustment is required to maintain the spark gap between the two electrodes in a spark igniter. Therefore, there is an increasing interest in using sparkless ignition for piloted systems.

Flame generators for igniting waste gases in a pilot line have been in service for a number of years and sold by companies such as Argo Flare Services (United Kingdom) and Hero Flare (Kellyville, Okla.). Flames may be generated using compressed air pilot systems or naturally aspirated systems. In the compressed air system, compressed air and fuel gas are metered into a mixer located in a single pilot tubing assembly at near grade level. A sparking device located in the pilot nozzle ignites the fuel and generates the fire ball. The pilot line is purged with the fuel prior to ignition. The fire balls travel to the flare tip and ignites the waste gases. Since the composition of the waste gases may change from time to time and requires balancing of air/fuel ratios, a supplemental fuel such as propane may be used in the pilot to insure reliable fireball generation. Instead of using compressed air, ambient air may be drawn into the mixer in the pilot line using a venturi effect caused by the fuel flow. These commercial systems generate a spark to ignite the air/fuel mixture and generate the flame front. As is well known, sparking rods require frequent maintenance. Hero Flare, for example, provides for pilots that may be raised and lowered from grade level to allow for maintenance.

An alternate to spark ignition is sparkless ignition using hot surface ignition (HSI) elements. U.S. Patent Publication No. US2012/0282555 entitled "HOT SURFACE IGNITION ASSEMBLY FOR USE IN PILOTS FOR FLARING INCINERATION, AND PROCESS BURNERS," describes a combustion chamber for generating a fireball to ignite a pilot. Ignition gas (fuel) is introduced to a combustion chamber and draws air in to the combustion chamber. Fuel and air is mixed and ignited by an HSI element. Combustion initiates a flame front, which may travel through a pipe until it ignites flare gases. This application does not disclose where the combustion chamber is located in the single pilot line assembly. Also, disclosed is a pilot assembly in which the HSI element is located in the pilot nozzle near the tip of the flare stack. Pilot fuel flows through a mixer where the gas is mixed with air drawn in by the fuel flow. The fuel/air mixture then reaches the pilot head (nozzle) where it is ignited by the HSI assembly, which is affixed to a head. A power source connected to a junction box provides power to the HSI element.

The Applicant has tested pilot assemblies that comprise a single pilot line assembly in which the HSI element is located in the pilot line nozzle that was located proximate to the flare stack tip. In this arrangement, the HSI is also used as a flame sensor. Methods for using the HSI element as a flame sensor are disclosed in commonly owned U.S. Patent Publication No. US2017/0284669, which is incorporated by reference herein in its entirety. In this assembly, fuel/air mixture flows up the pilot line and ignites upon contact with the energized HSI element. The durability of the HSI element, as used in this arrangement, was found to be poor because the HSI element was exposed to the extreme heat produced by the pilot flame, and because the HSI element was also exposed to weather conditions that caused thermal shock (e.g. caused by rain droplets) to the HSI element. The Applicant has also tested pilot assemblies that comprise a single pilot line and a spark igniter (in place of the HSI element) located in the pilot line nozzle that was positioned proximate to the flare stack tip. This arrangement was also plagued with unreliable pilot ignition because the spark igniter was rapidly covered with soot from the flare flame that burns rich, and deposits soot and debris on to the sparker rod causing a barrier for the spark to ground, which in turn caused the ignition coil to burn out frequently. Coil burnout results in downtime and increases maintenance cost. In addition, well operators also suffer from fines imposed by regulatory agencies because unburnt gases are exhausted to the atmosphere when flares are not functioning due to a pilot failure. Improved pilot assemblies and methods for operating the same for elevated flare stacks are therefore needed.

BRIEF DISCLOSURE

The exemplary pilot assembly comprising dual lines, namely, a fire path tubing and a pilot tubing as disclosed herein overcomes the deficiencies described above. The HSI element in the pilot assembly is disposed in the fire path tubing at a distance below the pilot nozzle, and is therefore not exposed to atmospheric elements and extreme heat generated by the pilot flame in the nozzle. Flame temperature is sensed using a thermocouple. The positioning of the thermocouple in the cooler part of the flame inside the disclosed pilot nozzle improves the durability of the thermocouple. The thermocouple in prior art pilot assemblies, for example in U.S. Patent Publication No. US2012/0282555 is attached to the external surface of the pilot nozzle, which exposes the thermocouple to extreme heat and results in frequent failure. Changing the thermocouple is not a trivial task because the pilot nozzle is often located 20 ft. to 100 ft. from grade level. The disclosed exemplary nozzle designs and venture fuel/air mixer designs improve the reliability of the pilot assembly.

Disclosed is a pilot assembly for igniting waste gases in an elevated flare stack comprising a fire path tubing having an inlet end and an outlet end and having a fuel inlet disposed at the inlet end, a pilot tubing having an inlet end and an outlet end and having a fuel inlet disposed at the inlet end. The pilot tubing is disposed substantially parallel to the fire path tubing. A pilot nozzle is configured to receive the outlet end of the pilot tubing at a first inlet and the outlet end of the fire path tubing at a second inlet, wherein the first and second inlets are disposed substantially orthogonal to each other. A hot surface ignition element (HSI) in fluid communication with the fire path tubing is disposed at a distance below the second inlet and wherein the tip of the HSI element is offset from the wall of the fire path tubing that receives the HSI element. A plurality of flame segments is generated in the fire path tubing by igniting a first premixed fuel/air mixture by the HSI element, which travel up the fire path tubing and ignites a second premixed fuel/air mixture entering the nozzle through the pilot tubing to create a pilot flame for igniting waste gases flowing through the elevated flare stack. The HSI element may be disposed preferably between about 1 ft. and 10 ft. below the second inlet of the nozzle and more preferably at about 5 ft. below the second inlet of the nozzle. The first and second premixed fuel/air mixtures are generated by premixing fuel and air using a venturi mixer disposed in the fire path tubing and pilot tubing respectively.

Disclosed is a pilot assembly for igniting waste gases in an elevated flare stack comprising a fire path tubing having an inlet end and an outlet end and having a fuel inlet disposed at the inlet end, a pilot tubing having an inlet end and an outlet end and having a fuel inlet disposed at the inlet end. The pilot tubing is disposed substantially parallel to the fire path tubing. A cylindrical pilot nozzle having a slotted opening disposed on its cylindrical surface to receive the outlet end of the fire path tubing and a fuel/air mixture distributing element insert adapted to receive the outlet end of the pilot tubing is disclosed. The entry of the fire path tubing into the nozzle is substantially orthogonal to the entry of the pilot tubing, and a hot surface ignition element (HSI) is disposed at a distance in fluid communication with the fire path tubing and at a distance below the nozzle. The tip of the HSI element is offset from the wall of the fire path tubing that receives the HSI element. A plurality of flame segments is generated in the fire path tubing by igniting a first premixed fuel/air mixture by the HSI element travel up the fire path tubing and ignites a second premixed fuel/air mixture entering the nozzle from the pilot tubing to create a pilot flame for igniting waste gases flowing through the elevated flare stack. The fuel/air mixture distributing element further comprises a neck region with a first end and a second end disposed opposite to the first end. The first end is adapted to receive the pilot tubing. A throat region having a first end is connected to the second end of the neck region. A second end of the throat region is disposed below the slotted opening. The diameter of the throat region at the first end is greater than the diameter of the throat region at the second end. The fuel/air mixture flows through the neck region and exits through the second end of the throat region. The nozzle is adapted to receive a thermocouple such that the tip of the thermocouple is disposed above the second end of the throat region of the fuel/air distributing element. The pilot assembly further comprising a first venturi mixer disposed in the fire path tubing upstream of the HSI element and a second venturi mixer disposed in the pilot tubing upstream of the nozzle. The first and second mixers provide the first and second fuel/air mixtures respectively. Each venturi mixer comprises an inlet end and outlet end disposed opposite to the inlet end, an orifice bracket adapted to mate with the inlet end of the mixer and adapted to receive an orifice component connected to a fuel supply, a neck region disposed downstream of the inlet end and in fluid communication with a throat region, wherein the diameter of the neck region is greater than the diameter of the throat region, and a diverging section disposed between the throat region and the outlet end of the mixer. At least 50% of the length of the orifice component is enclosed within the walls of the mixer at the inlet end to prevent breakage of the orifice component by high wind speeds.

Disclosed is a pilot flame light-off sequence method for an exemplary pilot assembly comprising energizing the HSI igniter during an ignition period, initiating fuel flow to the pilot assembly to generate a plurality of flame segments in the fire path tubing by igniting the fuel/air mixture using the energized HSI element wherein the plurality of flame segments enters the nozzle and ignites the fuel/air mixture entering the nozzle from the pilot tubing, measuring the change in flame temperature ($\Delta T$) in the nozzle relative to ambient temperature using the thermocouple after an interval period and shutting of fuel flow to the pilot assembly if the $\Delta T$ is less than a predetermined set point temperature and repeating the sequence. The ignition period is preferably between about 8 seconds and 15 seconds. The predetermined set point temperature is preferably 100° C. The interval period is preferably about 30 seconds. The method may also comprise the steps of measuring the flame temperature at intervals of about 10 seconds if $\Delta T$ is above a predetermined set point temperature, shutting off fuel flow if the flame temperature decreases by at least 1% from a maximum recorded flame temperature, and repeating the light off sequence up to three times after which the light-off sequence is terminated if the pilot flame is not sensed.

Disclosed is a pilot assembly for igniting waste gases in an elevated flare stack, comprising a fire path tubing having an inlet end and an outlet end and having a fuel inlet disposed at the inlet end, a pilot tubing having an inlet end and an outlet end and having a fuel inlet disposed at the inlet end, and a cylindrical pilot nozzle having a slotted opening disposed on its cylindrical surface to receive the outlet end of the fire path tubing and a fuel/air mixture distributing element insert adapted to receive the outlet end of the pilot tubing. The entry of the fire path tubing into the nozzle is substantially orthogonal to the entry of the pilot tubing. A spark igniter is disposed at a distance below the nozzle and in fluid communication with the fire path tubing. A plurality of flame segments generated in the fire path tubing by igniting a first premixed fuel/air mixture by the igniter travel up the fire path tubing and ignites a second premixed fuel/air mixture entering the nozzle from the pilot tubing to create a pilot flame for igniting waste gases flowing through the elevated flare stack.

Disclosed is a pilot assembly for igniting waste gases in an elevated flare stack, comprising a fire path tubing, a pilot tubing preferably disposed substantially parallel to the fire path tubing, a pilot nozzle configured to receive the pilot tubing at a first inlet and the fire path tubing at a second inlet, wherein the first and second inlets are disposed substantially orthogonal to each other; and a hot surface ignition element (HSI) in fluid communication with the fire path tubing wherein the tip of the HSI element is offset from the wall of the fire path tubing that receives the HSI element.

Other features and advantages of the present disclosure will be set forth, in part, in the descriptions which follow and the accompanying drawings, wherein the preferred aspects of the present disclosure are described and shown, and in part, will become apparent to those skilled in the art upon examination of the following detailed description taken in conjunction with the accompanying drawings or may be learned by practice of the present disclosure. The advantages of the present disclosure may be realized and attained by means of the instrumentalities and combinations particularly pointed out in the appendant claims.

DRAWINGS

The foregoing aspects and many of the attendant advantages of this disclosure will become more readily appreciated as the same becomes better understood by reference to the following detailed description, when taken in conjunction with the accompanying drawings, wherein:

FIG. 1. Schematic diagram of an exemplary pilot assembly for elevated flare stacks.

FIGS. 2A, 2B, 2C, 2D, and 2E depict a perspective view of an exemplary nozzle for a pilot assembly, cross sectional view of nozzle, cross sectional side view of nozzle, cross sectional side view of nozzle insert, and bottom view of insert, respectively.

FIGS. 3A, 3B, and 3C depict a perspective view of an exemplary fuel/air mixer, cross sectional side view of an exemplary fuel/air mixer, and side view and front view of an exemplary orifice bracket of the mixer, respectively.

Figure 4:
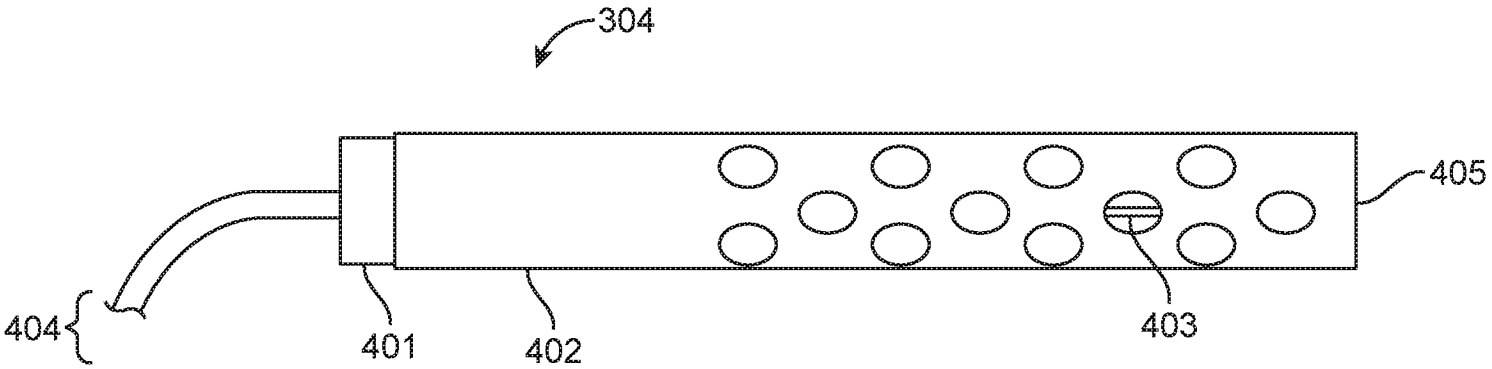

FIG. 4. Schematic diagram of an exemplary hot surface ignition (HSI) element.

Figure 5:
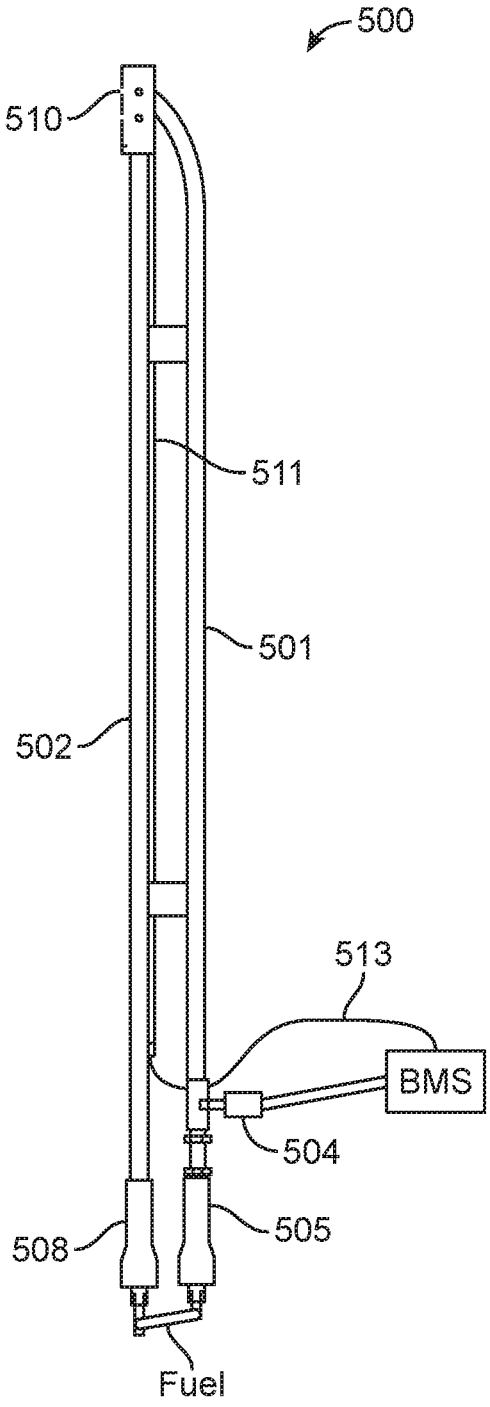

FIG. 5. Schematic diagram of an exemplary pilot assembly for elevated flare stacks with a spark igniter.

All reference numerals, designators and callouts in the figures are hereby incorporated by this reference as if fully set forth herein. The failure to number an element in a figure is not intended to waive any rights. Unnumbered references may also be identified by alpha characters in the figures and appendices.

The following detailed description includes references to the accompanying drawings, which form a part of the detailed description. The drawings show, by way of illustration, specific embodiments in which the pilot assembly and methods may be practiced. These embodiments, which are to be understood as "examples" or "options," are described in enough detail to enable those skilled in the art to practice the present invention. The embodiments may be combined, other embodiments may be utilized or structural or logical changes may be made without departing from the scope of the invention. The following detailed description is, therefore, not to be taken in a limiting sense and the scope of the invention is defined by the appended claims and their legal equivalents.

In this document, the terms "a" or "an" are used to include one or more than one, and the term "or" is used to refer to a nonexclusive "or" unless otherwise indicated. In addition, it is to be understood that the phraseology or terminology employed herein, and not otherwise defined, is for the purpose of description only and not of limitation. For construing the scope of the term "about," the error bounds associated with the values (dimensions, operating conditions etc.) disclosed is ±10% of the values indicated in this disclosure. The error bounds associated with the values disclosed as percentages is ±10% of the percentages indicated. The word "substantially" used before a specific word includes the meanings "considerable in extent to that which is specified," and "largely but not wholly that which is specified."

DETAILED DISCLOSURE

Particular aspects of the invention are described below in considerable detail for the purpose for illustrating its principles and operation. However, various modifications may be made, and the scope of the invention is not limited to the exemplary aspects described.

Figure 1:
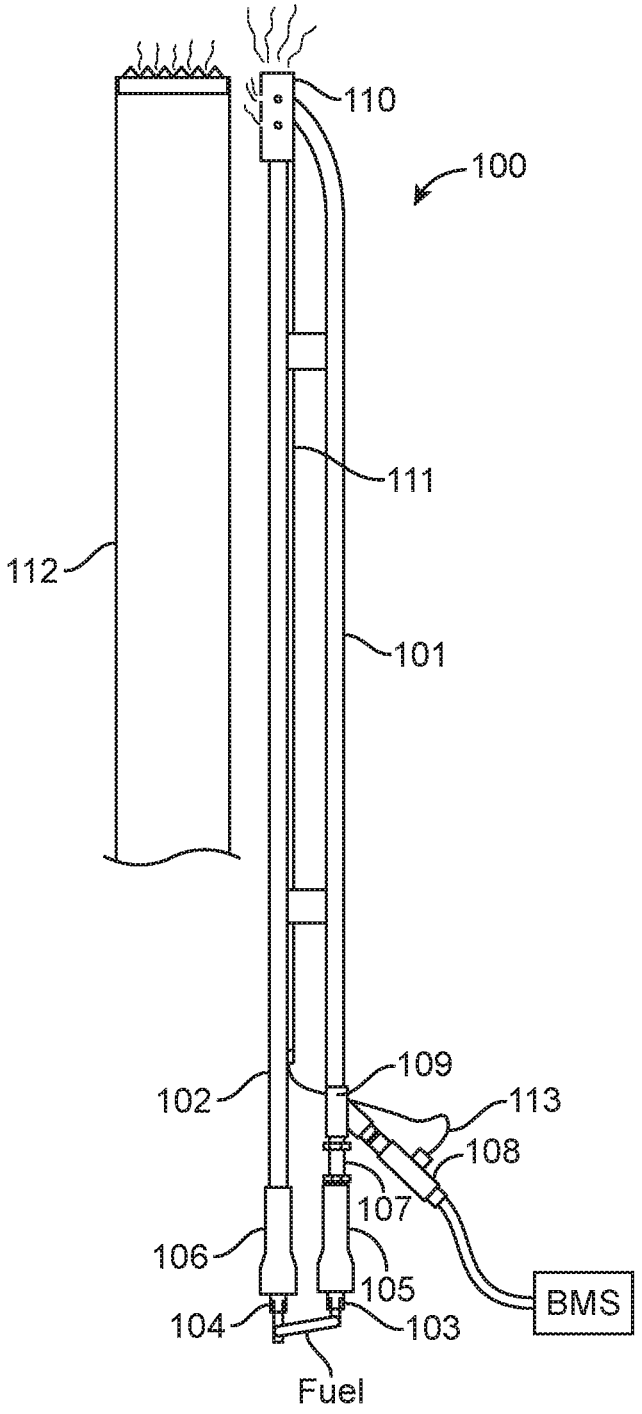

FIG. 1 illustrates various features of an exemplary pilot assembly 100. The assembly comprises a plurality of tubings, namely, a fire path tubing 101 and a pilot tubing 102 that are preferably disposed substantially parallel to each other. The tubings are generally ¾ in. in outer diameter, and made of Type 304 Stainless Steel. Tubings made of other alloys such as Type 316 Stainless Steel, Inconel, and the like may be used. The pilot assembly in turn is disposed substantially parallel to a flare stack 112. The pilot assembly may be between about 5 ft. and about 12 ft. in length, as measured from nozzle end 211 (FIG. 2C) to fuel inlet 103 or 104, and may be elevated using suitable mechanisms to the desired height from grade level such that pilot nozzle is positioned substantially proximate to the flare stack tip. Preferably, pilot nozzle 110 is about level with the flare stack tip. Flare stacks vary in height and may be 5 to 50 ft. in height and could even exceed 100 ft. in height. Fuel to the pilot assembly is typically off-gas from treatment units such as water/oil separators. Water/oil separators may be physical separators or heater treaters. The fuel is typically dehydrated and fed to the pilot assembly at a pressure of about 10 psig to 14 psig. Waste gases from oil storage or water storage tanks at well sites may vary in composition and are available at low pressure (about 0.5 to 8 ounce per sq. in.). Waste gases are flared. Because of varying gas composition and low pressures, waste gases are generally not suitable to be used as a fuel in pilot systems.

The fuel to the pilot assembly is split into two streams and fed to fuel inlet orifice component 103 in the fire path tubing and to fuel inlet orifice component 104 in the pilot tubing. Splitting of fuel flow to the pilot tubing and the fire path tubing in a desired ratio is achieved by selecting the orifice sizes. Preferably, 70% of the fuel feed is routed to the pilot tubing. To achieve this split the size of orifice component 104 may be about 0.040 in. and that of orifice component 103 may be about 0.025 in. Orifice components 103 and 104 and disposed at the bottom end (inlet end) of mixers 105 and 106 respectively. In each mixer, fuel is premixed (naturally aspirated) with air as the fuel flows through the mixer.

The fuel/air mixture exits mixer 105 in fire path tubing 101, flows through a reducer element 107 (typically ¾ in.×½ in.) and is ignited by hot surface igniter (HSI) 108. Ignitor 108 may be inserted into fitting 109 (preferably Y-shaped, a T-fitting may also be used) connected to tubing 101 and may be sealed using electrical seal-off cement. Alternately, igniter 108 may be inserted into an opening provided in the fire path tubing. Fitting 109 should be understood to be part of the fire path tubing. The igniter is preferably positioned such that tip 405 (FIG. 4) is facing upwards towards nozzle 110 of the pilot assembly. The tip of the HSI element does not extend inside tubing 101 into the flow path of the fuel/air mixture. Instead, it is offset from the wall of the fire path tubing that receives the HSI element. If fitting 109 is used, the tip is offset from the vertical wall (wall of fitting 109 that is substantially parallel to the fire path tubing wall) of fitting 109 that connects to fire path tubing 101. The offset is preferably less than about 0.75 in. away from the wall of the fire path tubing that receives the HSI element (or wall of fitting 109 that is substantially parallel to the fire path tubing wall). HSI element 108 may be positioned to be flush with the wall of the fire path tubing that receives the HSI element. Preferably, the HSI element tip is offset about 0.5 in. from the wall of the fire path tubing that receives the HSI element. The positioning of the HSI tip as described above does not impede the flow of fuel/air mixture in fire path tubing 101. It also generates a plurality of flame segments by the ignition of the fuel/air mixture by the energized HSI igniter 108, which travel up tubing 101 towards nozzle 110. Flame segments comprise one or more flame regions separated by one or more slugs of fuel/air mixture that flow up tube 101 towards nozzle 110. When the igniter 108 is not energized, a continuous flow of fuel/air mixture is realized in tubing 101.

Igniter 108 comprises an igniter heating element 403 (FIG. 4) that is substantially enclosed in a high temperature ceramic body 401. Wires 404 are electrically connected to igniter heating element 403 and are used to energize the igniter heating element using preferably a DC (direct current) electrical source. A portion of element 403 protrudes from the ceramic body 401. A high temperature alloy guard (e.g. Inconel guard) 402 protects the ceramic body, and the exposed part of heating element 403. The Inconel guard is preferably 0.4 in. to 0.5 in. in diameter, and more preferably 0.4 in. to 0.45 in. in diameter. HSI assembly (not including the length of the wires 404) is preferably between about 2 in. and about 3 in. in length, and more preferably between about 2 in. and about 2.5 in. in length. The length of the heating element 403 that protrudes from the ceramic body 401 is preferably between about 0.3 in. and about 0.6 in., and more preferably between about 0.4 in. and about 0.55 in. Ignition wiring 404 connected to the HSI element 108 is rated to withstand at least 1000° F. The wiring is routed to a burner management system (BMS). When the HSI element is energized, it heats up to 2800° F. and ignites fuel/air mixture to generate flame segments in tubing 101 as previously described. Reducer 107 increases the velocity of the fuel/air mixture and provides the driving force to push the flame segments up tubing 101 and through slotted opening 202 of pilot nozzle 110.

Figure 2A:
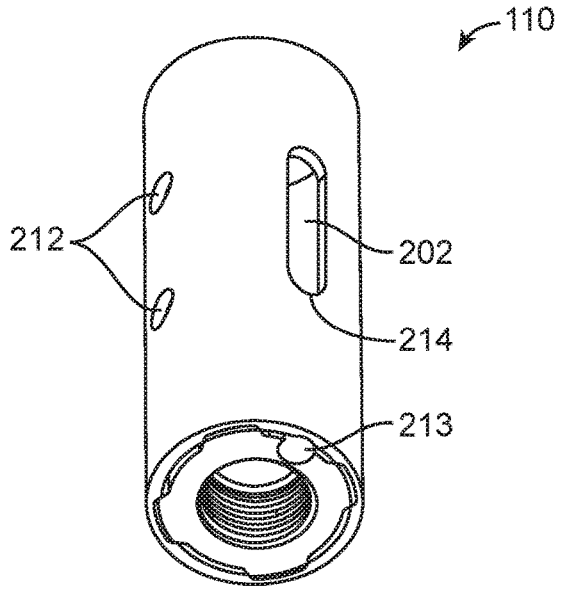
Figure 2B:
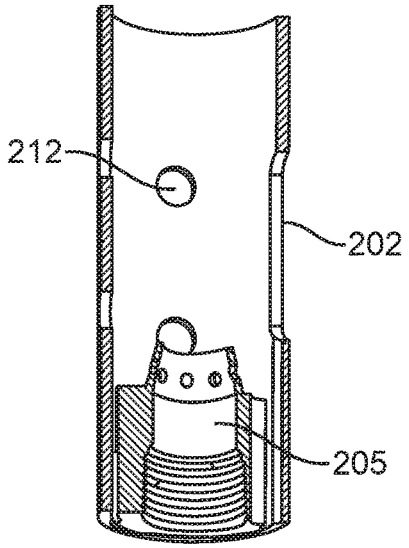
Figure 2C:
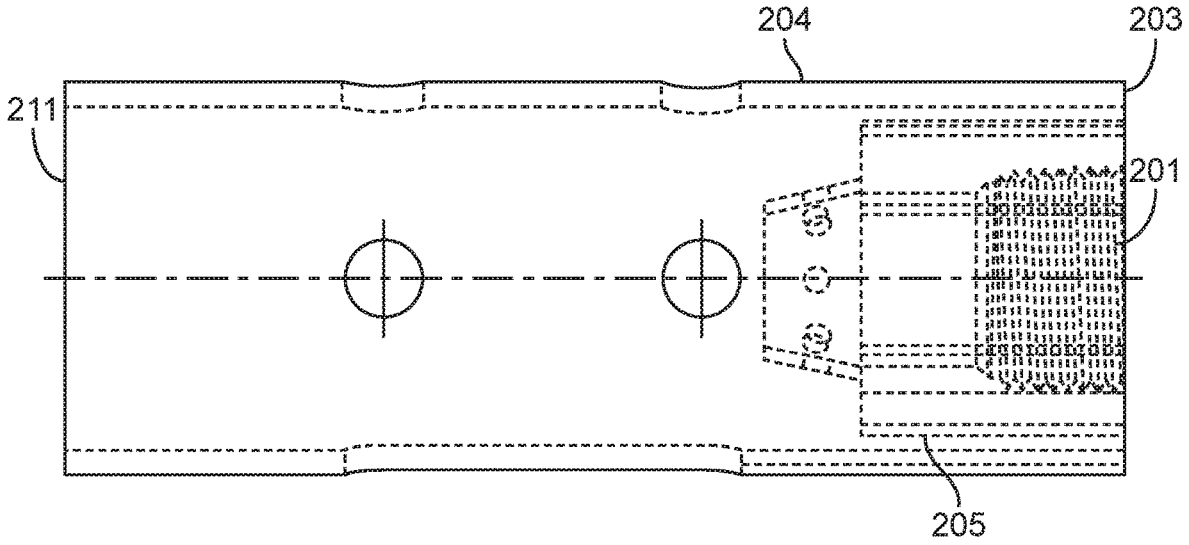
Figure 2D:
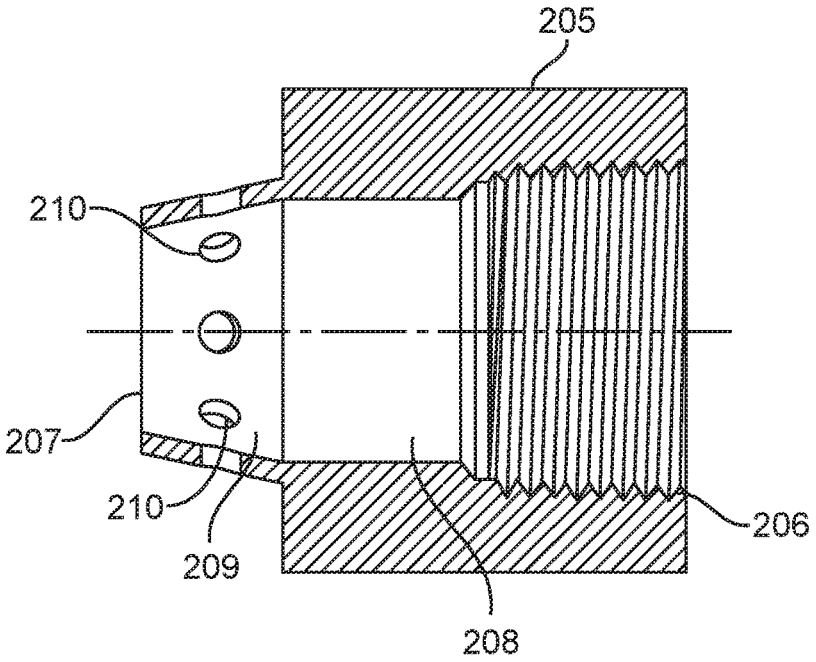
Figure 2E:
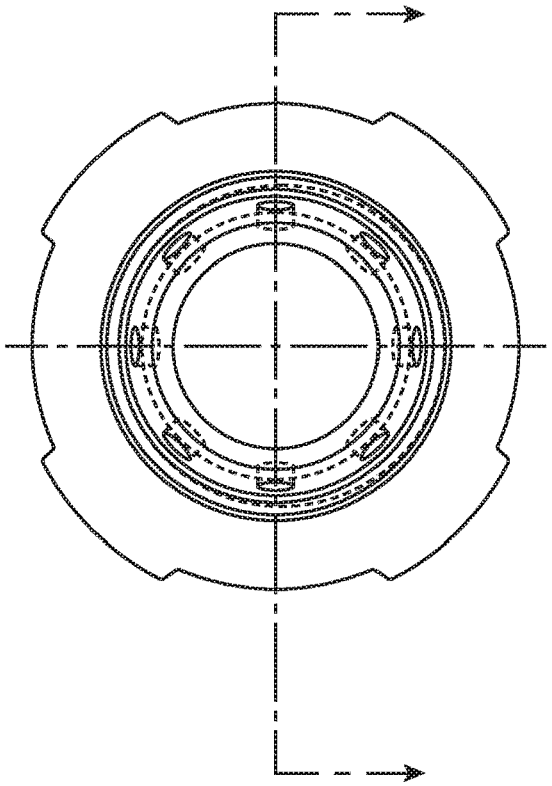

Exemplary nozzle 110 may be cylindrical in shape (FIG. 2), and comprises a 1½ in. Schedule 40 pipe (about 1.85 in. O.D.), and is preferably fabricated using at least one of Type 304 Stainless Steel, Type 316 Stainless Steel, and Type 310 Stainless Steel. The exemplary nozzle may be about 5 in. in length. Pilot tubing 102 may be removably connected to nozzle 110 at first inlet 201 located at bottom (inlet) end 203. Fire path tubing 101 may be connected to nozzle 110 at second inlet 202, which may be in the form of a slotted opening located on the cylindrical surface 204 of nozzle 110. Inlet 201 is disposed substantially orthogonal relative to inlet 202; that is, the plane of inlet 201 and that of 202 are substantially orthogonal to each other. Inlet 202 may be of various shapes (e.g. oval, cylindrical, rectangular) and is preferably in the shape of a slotted opening with radial ends as shown in FIG. 2A. The orthogonal orientation of the fire path tubing entry at inlet 202 relative to the pilot tubing entry prevents rain from entering the fire path tubing and subjecting the HSI element to thermal shock. As a result, the durability of the HSI element may be increased from a few weeks to several years. Pilot fuel/air mixture distributing element 205 (FIG. 2D) is inserted into nozzle 110 at inlet end 203 and welded in place. End 206 is adapted to receive pilot line 102, for example, using a ¾ in. NPT threaded connector. Fuel/air mixture flows through neck region 208 of element 205, and exits through throat region 209 and out of end 207. Neck region may be about 0.55 in. in length and about 0.82 in. in diameter, but other suitable dimensions may also be used. Throat region 209 may be about 0.45 in. in length and between about 0.69 in. to 0.75 in. in diameter at end 207, but other suitable dimensions may also be used. The velocity of the fuel/air mixture exiting from the pilot line 102 increases as it flows through throat region 209 and exits at end 207, and may be controlled using a plurality of openings 210, which are disposed in throat region 209. Openings (or holes) 210 are preferably about 0.125 in. in diameter, but other suitable dimensions may also be used. The pilot tubing fuel/air mixture is then ignited by the flame segments entering slotted opening 202 of nozzle 110, and provides a reliable pilot flame exiting at end 211 for the combustion of waste gases in the flare stack. End 207 is located less than about 0.1 in. to 0.2 in. below the bottom radial end 214 of inlet 202. It also prevents the extinguishing of the flame segments that enter nozzle 110 through slotted opening 202 prior to contacting with the fuel air mixture leaving exit 207. A plurality of holes 212, each about 0.375 in. in diameter, are also provided on the cylindrical surface of nozzle 110 to draw in air to stabilize the flame and to prevent the flame from lifting off the nozzle. The exemplary nozzle as disclosed herein is typically rated at 60,000 BTU/h at 10 psig when 1000 BTU/cu. ft. natural gas is used as the fuel. This rating is dependent on the fuel gas heating value and the gas pressure and is subject to change.

The presence of the pilot flame is detected using thermocouple (e.g. K type) 111 that is disposed outside the pilot line. The thermocouple tip enters nozzle 110 through opening 213, which is preferably drilled after welding insert element 205 in place at end 203 of nozzle 110. Opening 213 is preferably between about 0.3 in. and 0.35 in. in diameter, and is more preferably about 0.34 in. in diameter. Thermocouple 111 is positioned such that the thermocouple tip is located at about 2.25 in. above end 203 of the nozzle, which positions the thermocouple tip at approximately below the midpoint of slotted opening 202 (and approximately below the midpoint of the length of the nozzle). As the flame segments from fire path tubing 101 enter through slotted opening 202, it ignites the fuel/air mixture flowing out through insert 205. The thermocouple therefore senses the temperature of the cooler portion of the flame front that generally extends from openings 210 to below the mid-point of slotted opening 202, which is relatively cooler than the adiabatic flame temperature. The measured temperature is typically between about 1000° F. and 1500° F. depending on heating value of the natural gas fuel. Typical flame temperature when measured on the outside surface of the nozzle or when measured upstream of the midpoint of slotted opening 202 ranges from 1600° F. to 2500° F. depending upon the heating value of the natural gas fuel. The thermocouple positioning in exemplary nozzle 110 permits the detection of the pilot flame in nozzle 110 while increasing the durability of the thermocouple. Thermocouple wiring 113 may be directly connected to the BMS or may be routed to the BMS through the casing of igniter 108 as shown in FIG. 1. The thermocouple tip may also enter through an opening similar to openings 212 on the cylindrical surface of the nozzle 110, such that the tip is positioned at approximately below the midpoint of slotted opening 202. In this case, a portion of the thermocouple near the nozzle entry point would be bent and then positioned to run parallel to the pilot tubing.

In an alternate embodiment, the thermocouple tip may also be positioned on the outside surface of nozzle 110 below the midpoint of slotted opening 202. The tip may be inserted in a thermowell suitable affixed by welding or other means to the outer surface of the nozzle to protect the tip from atmospheric conditions (wind, rain etc.).

In an exemplary pilot flame light-off sequence for pilot assembly 100, the sequence is started by energizing the HSI igniter 108 over an ignition period. The ignition period is preferably between about 8 seconds and about 15 seconds. Igniter 108 is preferably using a DC voltage of about 12 volts to about 24 volts. The HSI igniter temperature rapidly increases to auto-ignition temperature of the fuel. The burner management system (BMS) then initiates fuel flow to pilot assembly 100. Upon ignition of the fuel/air mixture exiting from mixer 105, a plurality of flame segments is produced in fire path tubing 101, which travel up tubing 101, enter nozzle 110 through slotted opening 202, and ignites the pilot tubing fuel/air mixture exiting element 205 in nozzle 110. After an interval period, the BMS measures the change in flame temperature ($\Delta T$) in nozzle 110 relative to ambient temperature using the signal from thermocouple 111. Preferably the interval period is about 30 seconds. A $\Delta T$ value above a predetermined set point temperature indicates the presence of a pilot flame in nozzle 110. The predetermined temperature (set point) is preferably about 100° C. The values of $\Delta T$, ignition period, and interval period as indicated above are provided as examples only and other suitable values may be utilized and fall within the scope of the disclosed method. If $\Delta T$ is less than the predetermined set point temperature, ignition of the pilot fuel/air mixture failed to occur in nozzle 110. The BMS shuts off the fuel flow to the pilot assembly and the light-off sequence is repeated again. If ignition was successful, the BMS monitors flame temperature at intervals of about 10 seconds. A maximum temperature measured by the thermocouple is recorded. The pilot flame temperature typically levels off at 1000° F. to 1500° F. (maximum temperature) depending on the heating value of the fuel. A decrease in temperature by at least 1% of maximum temperature indicates the absence of a flame. The BMS then shuts off fuel flow and the sequence is repeated again up to three times. The BMS shuts off the fuel to the pilot assembly if a pilot flame is not sensed. Once a stable pilot flame is sensed by the BMS, ignitor 108 remains in a de-energized state. In this state, fuel/air mixture continues to flow through fire path tubing 101. A solenoid valve (not shown) may be optionally installed upstream or downstream of mixer 105 to cut-off fuel flow to the fire-path tubing after a reliable pilot flame has been established. The solenoid valve may be turned ON/OFF by the BMS and minimizes use of fuel in the pilot assembly.

The HSI igniter may comprise of durable, high temperature materials such as silicon carbide or silicon nitride. HSI assemblies are available from sources that include, but are not limited to, Robertshaw, Honeywell, and the like. These igniters may be energized using 12 to 24 VDC or 120 to 280 VAC. A burner management system (BMS) as disclosed in U.S. application Ser. No. 11/047,794 entitled "METHOD, APPARATUS AND SYSTEM FOR CONTROLLING A GAS-FIRED HEATER," which is incorporated by reference herein in its entirety, may be adapted to control the operation of pilot assembly 100.

Figure 3A:
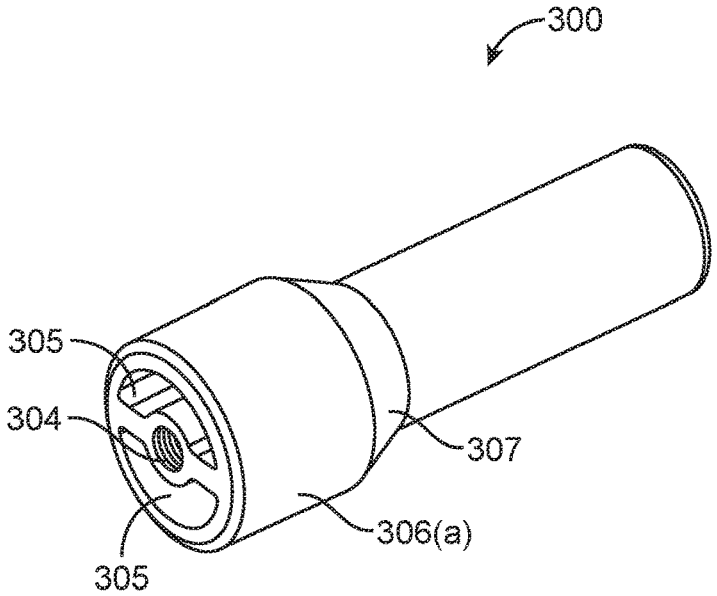
FIG. 3D depicts perspective view of an exemplary fuel/air mixer (top) and prior art mixer (bottom).
FIG. 3E depicts a front view of another exemplary orifice bracket.
Figure 3B:
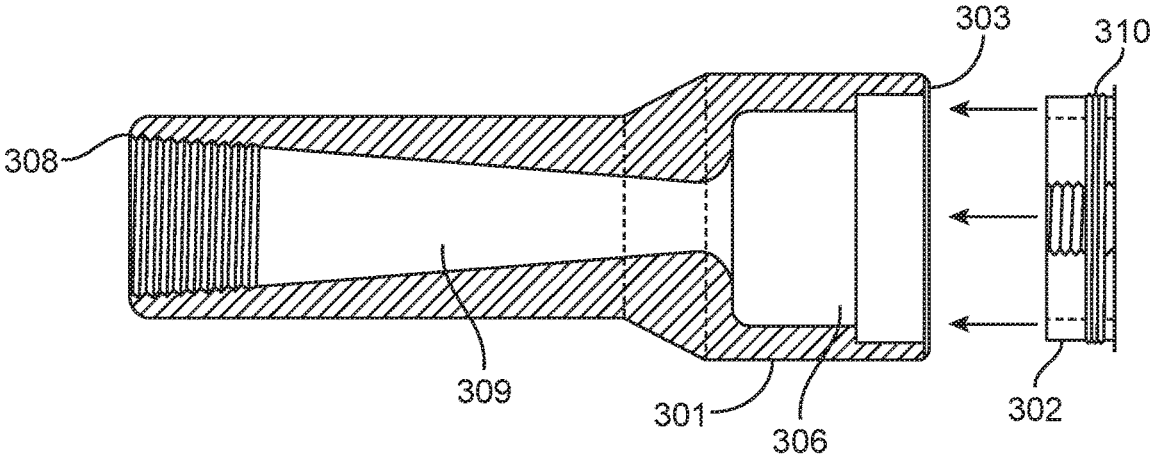
Figure 3C:
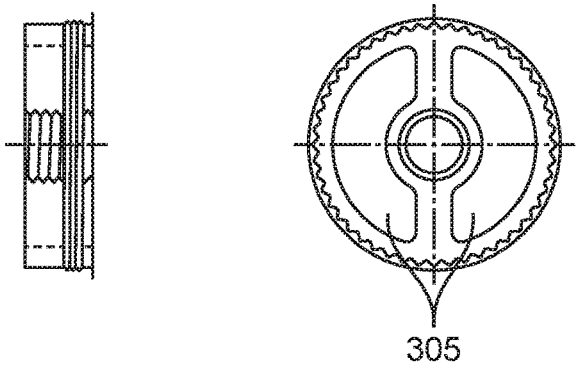
Figure 3D:
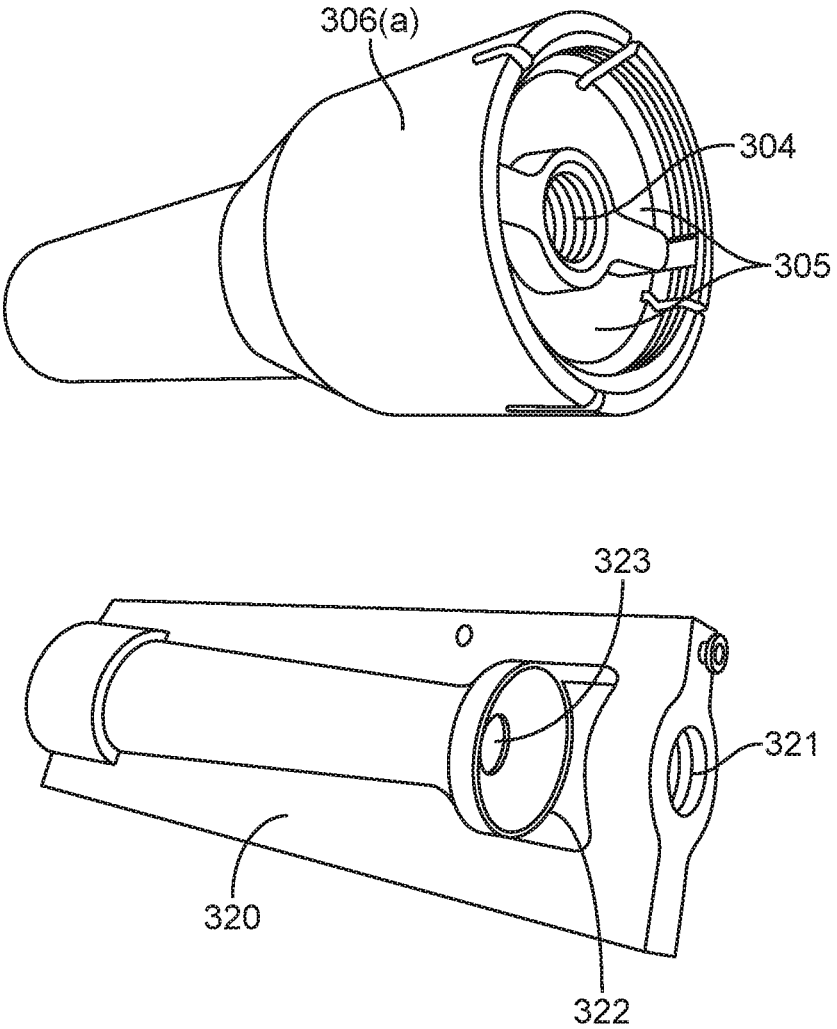
Figure 3E:
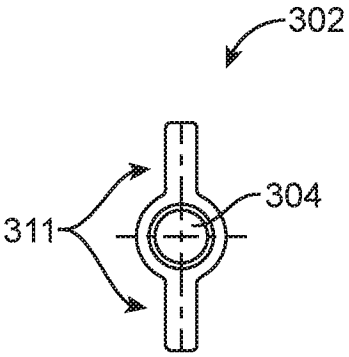

Fuel is pre-mixed with air in mixers 105 and 106 (shown as 300 in FIG. 3) located in fire path tubing 101 upstream of the HSI element and pilot tubing 102 upstream of the nozzle respectively. Exemplary mixers 105 and 106 are venturi type mixers and may be fabricated using at least one of precipitation-hardened aluminum 6061 alloy, cast iron, Type 304 Stainless Steel and cast aluminum. A venturi gas mixer uses Bernoulli's principle in a converging-diverging nozzle and converts the pressure energy of a motive fluid (fuel in this case) to velocity energy at the throat to create a low-pressure zone. This low-pressure zone draws in and entrains the suction fluid (air) into a mixing chamber where it mixes with the fuel. The gas mixture that leaves mixer 300 typically comprises of 10 parts air and 1 part natural gas. As shown in FIG. 3, mixer 300 comprises a venturi component 301, and an orifice bracket 302 that is adapted to mate with inlet end 303 of venturi component 301. The length of mixer 300 between inlet end 303 and outlet end 308 is less than about 10 in. and is preferably between about 5 in. and about 6 in. Orifice bracket 302 may be press-fit into end 303 of component 301 enabled by grooves 310 which may contain a high temperature permanent epoxy adhesive. Orifice bracket 302 may also be adapted to be welded or screwed on to component 301. Orifice components (103 or 104, FIG. 1) are connected to threaded connection 304 (e.g. ¼ in. NPT). As shown in FIG. 3C, the orifice bracket may provide for a plurality of air inlets 305. Alternately, as shown in FIG. 3E, orifice bracket 302 may provide a threaded connection 304 for receiving an orifice component, and comprise opposing arms 311 on either side of connection 304 that slide into grooves provided at inlet end 303 to create the plurality of air inlets 305. When installed in fire path tubing 101, fuel enters the mixer 105 (generally shown as 300 in FIG. 3) through the orifice component 103 that is preferably removably connected to threaded opening 304, enters chamber (neck region) 306 and flows through throat 307, diverging section 309, and exits through outlet end 308 into fire path tubing 101. Mixer 106 performs the same function for fuel feed into pilot tubing 102. As the fuel flows through throat 307, it draws in air through the plurality of air inlets 305. The ratio of the throat area to the fuel inlet area ($A_t/A_f$) generally controls the pressure loss through the venturi mixer. $A_t/A_f>0.6$ is desired to minimize pressure loss. In exemplary mixer 300, $A_t/A_f$ is about 1. Further, as shown in FIG. 3D, wall 306(*a*) of mixer 300 at inlet end 303 is in the form of a skirt (flared out) such that it encloses at least 50% of the length the orifice component. The length of orifice component (e.g. 103, 104) is about 2 in. When the orifice component is installed in mixer 300 at connection 304, it extends out of end 303 by about 0.8 inch. This ensures that wind does not shear-off the orifice component, especially when the pilot assembly is located at 50 ft. or more above grade level. In contrast, as shown in the prior art mixer 320 in FIG. 3D, orifice component enters through hole 321, passes through opening 322 which is exposed to ambient conditions and then connects to the mixer at screwed connection 323. The orifice component in mixer 320 is therefore substantially exposed to ambient conditions and is susceptible to shearing-off during windy conditions. Breakage or shearing-off of the orifice component will stop fuel flow to the pilot assembly and cause flame out.

The BMS may also be used to measure the resistance of HSI element 108 to check the health of the HSI element. Aging of the resistance wires may occur at high temperatures, due to cyclic operation, and possibly due to some carbon formation. The resistance of the HSI element is also a function of the age of the HSI element. Aging generally causes an increase in the resistance of the HSI element. The resistance of a fresh HSI element is about 2 ohms, and more typically between 1.6 and 2.4 ohms at a reference temperature of 50° C. An aged igniter element is characterized by a resistance of about 4.5 ohms at a reference temperature of 50° C. An increase in measured resistance at a reference temperature would suggest that the heating element is aging. As a remedial measure, the energizing voltage to the HSI element may be increased in steps of about 0.5 volts (when DC voltage is used) to compensate for the aging of the heating element. Increasing the energizing voltage is warranted if the measured resistance at a reference temperature exceeds the baseline resistance by more than 50%, and preferably by more than 75% to compensate for ageing of the hot igniter surface assembly. If this action fails, replacement of the HSI element would be required. The control methods in the burner management system can also keep track of the service time of the HSI element, and increase resistance accordingly to offset the effects of aging to achieve a predetermined ignition temperature.

Alternately, instead of using an HSI element 108, flame segments in the fire path tubing of exemplary pilot assembly 500 may be generated using a spark igniter 504 (FIG. 5). Similar to pilot assembly 100, pilot assembly comprises fire path tubing 501 and pilot tubing 502. The tips of the spark igniter may be installed in the air/fuel mixture path flowing through the fire path tubing that is disposed substantially parallel to pilot tubing 502. The spark igniter wiring and thermocouple 511 wiring 513 are routed to a BMS that is adapted to control a spark ignition pilot assembly. Mixers 505 and 506 and nozzle 510 of pilot assembly 500 may be substantially similar those previously described for use in pilot assembly 100. Spark igniters generally require frequent maintenance to remove soot build up and/or to adjust the gap between the rods. The pilot assembly with a spark igniter would require to be periodically lowered to grade level for checking the gap between the sparking rod tips.

In an exemplary pilot flame light-off sequence for pilot assembly 500, the sequence is started by energizing the spark igniter 504. Igniter 504 is preferably energized using a DC voltage of about 12 volts to about 24 volts. The burner management system (BMS) then initiates fuel flow to pilot assembly 500. Upon ignition of the fuel/air mixture exiting from mixer 505, a plurality of flame segments is produced in fire path tubing 501, which travel up tubing 501, enter nozzle 510 and ignites the pilot tubing fuel/air mixture in nozzle 510. After an interval period, the BMS measures the change in flame temperature ($\Delta T$) in nozzle 510 relative to ambient temperature using the signal from thermocouple 511. Preferably the interval period is about 30 seconds. A $\Delta T$ value above a predetermined set point temperature indicates the presence of a pilot flame in nozzle 510. The predetermined temperature (set point) is preferably about 100° C. The values of $\Delta T$ and interval period as indicated above are provided as examples only and other suitable values may be utilized and fall within the scope of the disclosed method. If measured $\Delta T$ is less than the predetermined set point temperature, ignition of the pilot fuel/air mixture failed to occur in nozzle 510. The BMS shuts off the fuel flow to the pilot assembly and the light-off sequence is repeated again. If ignition was successful, the BMS monitors flame temperature at intervals of about 10 seconds. The pilot flame temperature typically levels off at 1000° F. to 1500° F. depending on the heating value of the fuel. A decrease in temperature by at least 1% of maximum temperature indicates the absence of a flame. The BMS then shuts off fuel flow and the sequence is repeated again up to three times. The BMS shuts off the fuel to the pilot assembly if a pilot flame is not sensed. Once a stable pilot flame is sensed by the BMS, ignitor 504 remains in a de-energized state. In this state, fuel/air mixture continues to flow through fire path tubing 501. A solenoid valve (not shown) may be optionally installed upstream of mixer 505 to cut-off fuel flow to the fire-path tubing after a reliable pilot flame has been established. This solenoid valve may be turned ON/OFF by the BMS and minimizes use of fuel in the pilot assembly.

In another exemplary pilot assembly, the fire path tubing and the pilot tubing in the pilot assembly may be arranged as concentric tubes. In one embodiment of this pilot assembly, the pilot tubing may comprise the inner tubing and fire path tubing may comprise the outer tubing in the concentric arrangement. In another embodiment, the inner tube may comprise the fire path tubing, which would be protected from ambient conditions by the outer pilot tubing. Various options to connect the outlet end of the pilot tubing and the outlet end of the fire path tubing to the pilot nozzle are within the scope of this disclosure. Preferably, the fire path tubing entry into the nozzle is substantially orthogonal to the pilot tubing entry into the nozzle as previously described. The exemplary nozzle and mixer designs may be utilized in this exemplary pilot assembly.

The Abstract is provided to comply with 37 C.F.R. § 1.72(b), to allow the reader to determine quickly from a cursory inspection the nature and gist of the technical disclosure. It should not be used to interpret or limit the scope or meaning of the claims.

Although the present disclosure has been described in connection with the preferred form of practicing it, those of ordinary skill in the art will understand that many modifications can be made thereto without departing from the spirit of the present disclosure. Accordingly, it is not intended that the scope of the disclosure in any way be limited by the above description.

It should also be understood that a variety of changes may be made without departing from the essence of the disclosure. Such changes are also implicitly included in the description. They still fall within the scope of this disclosure. It should be understood that this disclosure is intended to yield a patent covering numerous aspects of the disclosure both independently and as an overall system and in both method and apparatus modes.

Further, each of the various elements of the disclosure and claims may also be achieved in a variety of manners. This disclosure should be understood to encompass each such variation, be it a variation of an implementation of any apparatus implementation, a method or process implementation, or even merely a variation of any element of these.

Particularly, it should be understood that the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this disclosure is entitled. It should be understood that all actions may be expressed as a means for taking that action or as an element which causes that action. Similarly, each physical element disclosed should be understood to encompass a disclosure of the action which that physical element facilitates.

In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Further, the use of the transitional phrase "comprising" is used to maintain the "open-end" claims herein, according to traditional claim interpretation. Thus, unless the context requires otherwise, it should be understood that variations such as "comprises" or "comprising," are intended to imply the inclusion of a stated element or step or group of elements or steps, but not the exclusion of any other element or step or group of elements or steps. Such terms should be interpreted in their most expansive forms so as to afford the applicant the broadest coverage legally permissible.

What is claimed is:

1. A pilot assembly for igniting oil and gas well site waste gases in an elevated flare stack, the pilot assembly comprising:

a fire path tubing having an inlet end and an outlet end and having a fuel inlet disposed at the inlet end;

a pilot tubing having an inlet end and an outlet end and having a fuel inlet disposed at the inlet end wherein the pilot tubing is disposed substantially parallel to the fire path tubing;

a pilot nozzle configured to receive the outlet end of the pilot tubing at a first inlet and the outlet end of the fire path tubing at a second inlet wherein the first and second inlets are disposed substantially orthogonal to each other wherein the nozzle is adapted to receive a thermocouple to detect the presence of a pilot flame; and, a hot surface ignition element (HSI) disposed at a distance below the second inlet and in fluid communication with the fire path tubing wherein the tip of the HSI element is offset from the wall of the fire path tubing that receives the HSI element wherein the tip of the HSI element does not extend inside the fire path tubing into the flow path of the fuel/air mixture and wherein a plurality of flame segments generated in the fire path tubing by igniting a first premixed fuel/air mixture by the HSI element travel up the fire path tubing and ignites a second premixed fuel/air mixture entering the nozzle through the pilot tubing to create the pilot flame for igniting waste gases flowing through the elevated flare stack.

2. The pilot assembly of claim 1 wherein the HSI element is disposed preferably between about 1 ft. and 10 ft. below the second inlet of the nozzle.

3. The pilot assembly of claim 1 wherein the first inlet is disposed below the second inlet of the pilot nozzle.

4. The pilot assembly of claim 1 wherein the first and second premixed fuel/air mixtures are generated by premixing fuel and air using a venturi mixer disposed in the fire path tubing and pilot tubing respectively wherein a fuel at a pressure of about 10 psig to 14 psig is split such that 70% of the fuel is routed to the pilot tubing and the remaining to the fire path tubing of the pilot assembly.

5. The pilot assembly of claim 1 wherein the hot surface igniter assembly is cylindrical.

6. The pilot assembly of claim 1 wherein the hot surface igniter element is energized using DC voltage.

7. The pilot assembly of claim 6 wherein the DC voltage ranges from 12 to 24 volts.

8. The pilot assembly of claim 1 wherein the HSI element tip offset is less than about 0.75 inches.

9. The pilot assembly of claim 1 wherein the HSI element tip is offset by about 0.5 inches.

10. The pilot assembly of claim 1 wherein the nozzle is cylindrical in shape.

11. The pilot assembly of claim 1 wherein the nozzle is made of at least one of Type 304 Stainless Steel, Type 316 Stainless Steel, and Type 310 Stainless Steel.

12. The pilot assembly of claim 1 wherein the nozzle is adapted to receive the thermocouple through an opening disposed near the first inlet wherein the tip of the thermocouple is disposed below the midpoint of the length of the nozzle.

13. A pilot flame light-off sequence for pilot assembly of claim 12, the sequence comprising:

energizing the HSI igniter during an ignition period;

initiating fuel flow to the pilot assembly and generating a plurality of flame segments in the fire path tubing by igniting the fuel/air mixture using the energized HSI element wherein the plurality of flame segments enters the nozzle and ignites the fuel/air mixture entering the nozzle from the pilot tubing;

measuring the change in flame temperature ($\Delta T$) in the nozzle relative to ambient temperature using the thermocouple after an interval period; and, if the $\Delta T$ is less than a predetermined set point temperature shutting of fuel flow to the pilot assembly and repeating the sequence.

14. The method of claim 13 wherein the ignition period is between about 8 seconds and 15 seconds.

15. The method of claim 13 wherein the predetermined set point temperature is about 100° C.

16. The method of claim 13 wherein the interval period is about 30 seconds.

17. The method of claim 13 further comprising the following steps:

measuring the flame temperature at intervals of about 10 seconds if $\Delta T$ is above the predetermined set point temperature;

recording a maximum temperature measured by the thermocouple;

shutting off fuel flow if the flame temperature decreases by at least 1% from the maximum temperature; and, repeating the light off sequence up to three times after which the light-off sequence is terminated if the pilot flame is not sensed.

18. The method of claim 17 wherein the maximum temperature is between about 1000° F. and about 1500° F. depending on the heating value of the fuel.

* * * * *